US008381359B1

(12) United States Patent
McArdle

(10) Patent No.: US 8,381,359 B1
(45) Date of Patent: Feb. 26, 2013

(54) HAT CONNECTING SUNGLASS RETENTION CLIP(S)

(75) Inventor: Robert C. McArdle, Medina, OH (US)

(73) Assignee: Shadesaverz, Inc., Medina, OH (US)

( * ) Notice: Subject to any disclaimer, the term of this patent is extended or adjusted under 35 U.S.C. 154(b) by 290 days.

(21) Appl. No.: 12/652,358

(22) Filed: Jan. 5, 2010

Related U.S. Application Data

(60) Provisional application No. 61/142,680, filed on Jan. 6, 2009.

(51) Int. Cl.
*A45F 5/06* (2006.01)

(52) U.S. Cl. ..... 24/3.12; 24/3.3; 2/209.13; 351/155

(58) Field of Classification Search ..... 24/3.3, 24/457, 3.12, 3.6; 2/10, 426, 209.13; 351/155
See application file for complete search history.

(56) References Cited

U.S. PATENT DOCUMENTS

| | | | | | |
|---|---|---|---|---|---|
| 1,198,105 | A * | 9/1916 | Butler | 24/3.6 |
| 1,281,656 | A * | 10/1918 | Raschick | 24/3.12 |
| 4,277,863 | A * | 7/1981 | Faneuf | 24/3.12 |
| 5,082,225 | A * | 1/1992 | Nespoli | 248/231.81 |
| 5,137,242 | A * | 8/1992 | Reath | 248/309.1 |
| 5,619,774 | A * | 4/1997 | Perry | 24/3.6 |
| 5,829,103 | A * | 11/1998 | Allen | 24/11 R |
| 5,867,874 | A * | 2/1999 | Simpson | 24/336 |
| 5,975,476 | A * | 11/1999 | Mancinelli | 248/316.7 |
| 6,045,221 | A * | 4/2000 | Resendez, Sr. | 351/112 |
| 6,298,495 | B1 | 10/2001 | Totani | |
| 6,481,059 | B2 * | 11/2002 | Morris | 24/3.12 |
| 6,484,365 | B1 * | 11/2002 | Thompson | 24/3.12 |
| 6,637,074 | B1 * | 10/2003 | Morris | 24/3.12 |
| 6,644,807 | B1 | 11/2003 | Hood | |
| 6,668,426 | B1 * | 12/2003 | Morris | 24/3.3 |
| 6,691,374 | B2 * | 2/2004 | Coyne | 24/3.3 |
| 6,792,619 | B1 | 9/2004 | Morris et al. | |
| 6,935,742 | B1 | 8/2005 | Wilson, Sr. | |
| 7,051,406 | B1 * | 5/2006 | Morris et al. | 24/3.12 |
| 7,178,278 | B1 * | 2/2007 | Morris | 40/329 |
| 7,229,172 | B2 * | 6/2007 | Presswood et al. | 351/155 |
| 7,275,270 | B2 | 10/2007 | Cotutsca | |
| D571,982 | S | 7/2008 | Kirby | |
| 7,866,813 | B2 * | 1/2011 | Anhalt | 351/155 |
| 7,954,943 | B2 * | 6/2011 | Ledford | 351/155 |
| 7,979,921 | B2 | 7/2011 | Cotutsca | |
| 2002/0069488 | A1 * | 6/2002 | Morris | 24/3.12 |
| 2007/0022573 | A1 * | 2/2007 | Cheng | 24/3.3 |

* cited by examiner

*Primary Examiner* — Robert J Sandy
*Assistant Examiner* — Rowland D Do
(74) *Attorney, Agent, or Firm* — Hahn Loeser & Parks, LLP; Carlos P. Garritano

(57) ABSTRACT

A hat connecting sunglass retention clip is provided having a curved inner surface, a spring urged clamp for frictionally impinging to the hat inner sidewall, and a pair of retaining spikes that both impinge against the hat outer sidewall as well as form upper and lower retention walls for securing the eyeglass arms thereto.

20 Claims, 10 Drawing Sheets

HAT CONNECTING SUNGLASS RETENTION CLIP(S)

RELATED APPLICATIONS

The present invention claims benefit of U.S. Provisional Application 61/142,680, filed on Jan. 6, 2009 and incorporated by reference as if fully rewritten herein.

BACKGROUND OF THE INVENTION

1. Field of the Invention

The present invention relates generally to a sunglass retention clip(s) and, more particularly, to a sunglass retention clip having a curved inner surface, a spring urged clamping means for frictionally impinging to the hat inner sidewall, and a pair of retaining spikes that both impinge against the hat outer sidewall as well as form upper and lower retention walls for securing the eyeglass arms thereto.

2. Description of the Related Art

Although a number of methods exist for retaining eyeglasses of all varieties, including but not limited to sunglasses, safety glasses or the like (collectively "eyeglasses"), they may require an alteration of the hat or cap or require the user to slide the ear piece of the glasses into a holder. Such holders generally protrude into the inner volume of the hat wearing area, thereby forming an uncomfortable impingement between the hat and the user's head. Also, such devices either fail to provide optimal retention friction to the hat, the eyeglass holding arms, or both. Further, they are made from unacceptable materials and/or they are non uniform in shape. As such, the current art will not work with all styles of ear pieces, whether they are manufactured from metal or plastic.

A search of the prior art did not disclose any patents that read directly on the claims of the instant invention; however, the following references were considered related.

U.S. Pat. No. 6,668,426, issued in the name of Morris, discloses safety glasses holders and eye glass holder for securing to hats or fabric comprising a fixed fastener design, wherein said fastener design has a broad Y-shaped insertion point, a rigid or resilient serrated tooth or ratchet type interference eyeglass holder mechanism and a narrowing U-shaped body similar to the shape of an eyeglass arm and fastening design which allows the fastener to either be sewn into or glued onto the hat for holding the arm of a pair of eye glasses, sun glasses or safety glasses.

U.S. Pat. D571,982, issued in the name of Kirby, discloses an ornamental design for a hat.

U.S. Pat. No. 6,792,619, issued in the name of Morris et al., discloses an implement holder to be attached to a cap, hat, clothing or other item is provided. The holder is a single unit, which can be integrated into the construction of the cap, hat, clothing or other item or removably attached to the outer surface of the article. The two sides of the unit are attached and form a loop for receiving a pencil, pen or other elongated implement. The unit additionally contains an adjustable flap for receiving the temple of eyewear, including glasses, sunglasses, or protective eye gear. The outer side of the unit is smooth and is designed to receive identifying or advertising indicia.

U.S. Pat. No. 6,298,495, issued in the name of Totani, discloses a hat with an insertion hole adapted to permit a temple of a pair of glasses to be inserted therein, positioned in each lateral side of the edge portion of the crown of a hat. The hat is so formed as to permit the temples of the glasses to be positioned between the crown and the slip band that is provided along the inner surface of the edge portion of the crown.

U.S. Pat. No. 6,637,074, issued in the name of Morris, discloses safety glasses holders and eye glass holders for securing to hats or fabric comprising a clip on design and a fastening design, wherein said clip design has an adjustable height design and fastening design which allows the clip to either be temporarily attached to a hat by way of the clip or sewn into the hat and/or comprises a frame secured to the insides of a hat with pins attached to and extending from said frame and penetrating said hat to attach to and engage the adjustable height clip for holding the arm of a pair of safety glasses.

U.S. Pat. No. 7,275,270, issued in the name of Cotutsca, discloses a utility holder assembly for securely holding articles such as eyewear and the like, small tools and accessories such as screwdrivers, flash lights, pliers, and the like, and writing utensils such as pencils, pens and the like to the sides of various types and styles of headwear. The utility holder assembly may be mounted on the outside surface or the inside surface of the headwear to accommodate easy insertion of an article for temporary storage. The holder may include a gripping mechanism such as hook and loop fasteners, a ductile layer, or a ductile member, such that the holder may be configured to conform to the shape of the article to more securely retain the article within the holder.

U.S. Pat. No. 6,644,807, issued in the name of Hood, discloses a pair of eyeglass temple holders attached to opposite sides of a hat, a baseball cap and other types of headwear. The temple holders are releasably attached to ends of a pair of temples attached to a pair of eyeglasses, which eliminate the need of placing the ends of the temples on top of a wearer's ears. Each of the pair of eyeglass temple holders includes an elastic strap with a rear end of the strap attached to a rear of one side of the headwear. A front end of the elastic strap is attached to a temple fastener. The temple fastener is used for releasably engaging an end of a temple, which is part of a pair of eyeglasses. The temple fastener, in one embodiment, can be hollow plastic tube with one end inserted in a press fit into the end of the temple. The temple end fastener, in additional embodiments, can be hook and loop fasteners or a metal snap with a post received in a hole in the end of the temple. The elastic straps of the temple holders allows the eyeglasses to be moved from a resting position next to the sides and front of the headwear to a position in front of the wearer's eyes.

U.S. Pat. No. 6,481,059, issued in the name of Morris, discloses safety glasses holders and eye glass holders for securing to hats or fabric comprising a wedge shaped design, a clip on design and a fastening design, wherein said fastening design comprises a frame secured to the insides of a hat, a first and second elastic cord or pin penetrating said hat and secured to said frame, and a strip disposed between said first and second elastic cords or pins for holding the arm of a pair of safety glasses.

U.S. Pat. No. 6,935,742, issued in the name of Wilson, Sr., discloses a strap that has two hooks placed on the ends and a curved clip in the center of the strap. The strap is elastic so that it holds onto a hat brim firmly. Once in place, the strap stays on the brim until it is needed. Because there is no large clip, the strap can be used on sun visors as well as hats. To store eye ware, the user places the eye ware on the brim and flips the curved clip over the bridge of the glasses. To release the glasses; the user simply flips the curved hook back, thereby releasing the glasses. Moreover, the user can easily remove the strap when it is not needed. Thus, the device does not permanently alter the look of the hat. Finally, because the device hooks onto the brim, it does not alter the feel of the hat when worn.

United States Patent Application Publication 2007/0220656, filed in the name of Cotutsca, discloses a utility holder assembly for securely holding articles such as eyewear and the like, small tools and accessories such as screwdrivers, flash lights, pliers, and the like, and writing utensils such as pencils, pens and the like to the sides of various types and styles of headwear. The utility holder assembly may be mounted on the outside surface or the inside surface of the headwear to accommodate easy insertion of an article for temporary storage. The holder may include a gripping mechanism such as hook and loop fasteners, a ductile layer, or a ductile member, such that the holder may be configured to conform to the shape of the article to more securely retain the article within the holder. The utility holder may also hold an article securely when the headwear is removed.

While the capacity to accept and retain the support arms of eyeglasses are incorporated into this invention in combination, other elements are different enough as to make the combination distinguished over the inventors' own prior art.

Consequently, there is a need in the art for an improved clip design that provides an attachment clip having a curved inner surface, a spring urged clamping means for frictionally impinge to the hat inner sidewall, and a pair of retaining spikes that both impinge against the hat outer sidewall as well as form upper and lower retention walls for securing the eyeglass arms thereto.

SUMMARY OF THE INVENTION

It is a feature of the present invention to provide an improved hat connecting eyeglass retention clip having a curved inner surface for comfortable impingement between the hat rim and the user's head.

Briefly described according to one embodiment of the present invention, an attachment clip is provided having a curved inner surface, a spring urged clamping means for frictionally impinging to the hat inner sidewall, and a pair of retaining spikes that both impinge against the hat outer sidewall as well as form upper and lower retention walls for securing the eyeglass arms thereto.

An advantage of the present invention is that attachment clip is provided having a curved inner surface to provide a comfortable resting surface when impinged between the hat and the user's head.

Another advantage of the present invention is that the attachment clip incorporates a spring urged clamping means for frictionally impinging to the hat inner sidewall of the hat.

Further, a preferred embodiment of the present invention forms a pair of retaining spikes that both impinge against the outer sidewall of a hat as well as form upper and lower retention walls for securing the eyeglass arms thereto.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 6 is an outside bottom perspective view of the embodiment shown in

FIG. 5;

FIG. 7 is an inside bottom perspective view of the embodiment shown in

FIG. 4;

DESCRIPTION OF THE PREFERRED EMBODIMENTS

Figure 1:
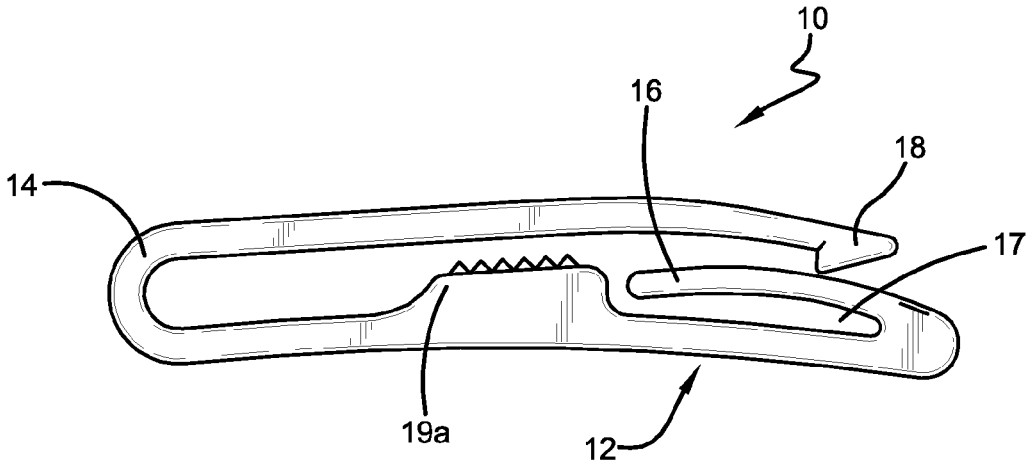
FIG. 1 is a right side elevational view of an eyeglass retention clip for supporting sunglasses on a hat or cap according to the preferred embodiment of the present invention.
Figure 2:
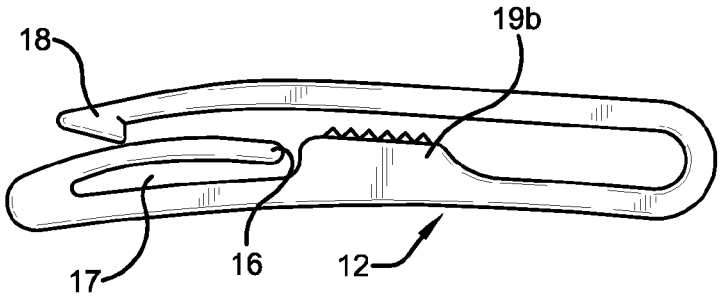
FIG. 2 is a left side elevational view thereof.
Figure 3:
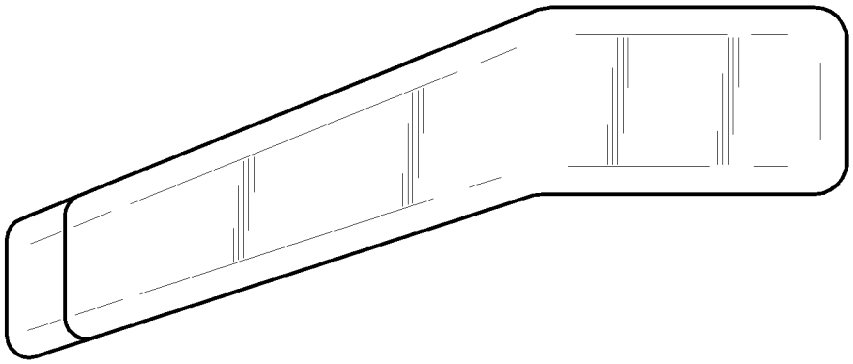
FIG. 3 is a rear elevational view thereof.
Figure 4:
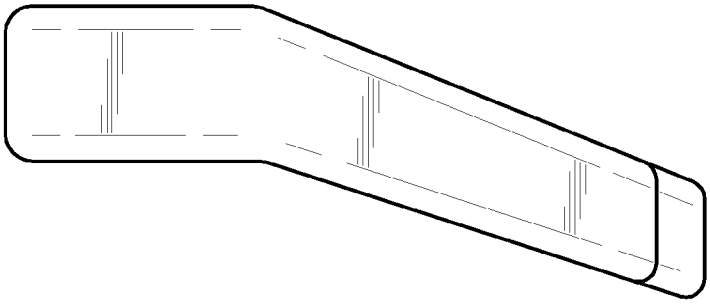
FIG. 4 is a front elevational view thereof.
Figure 5:
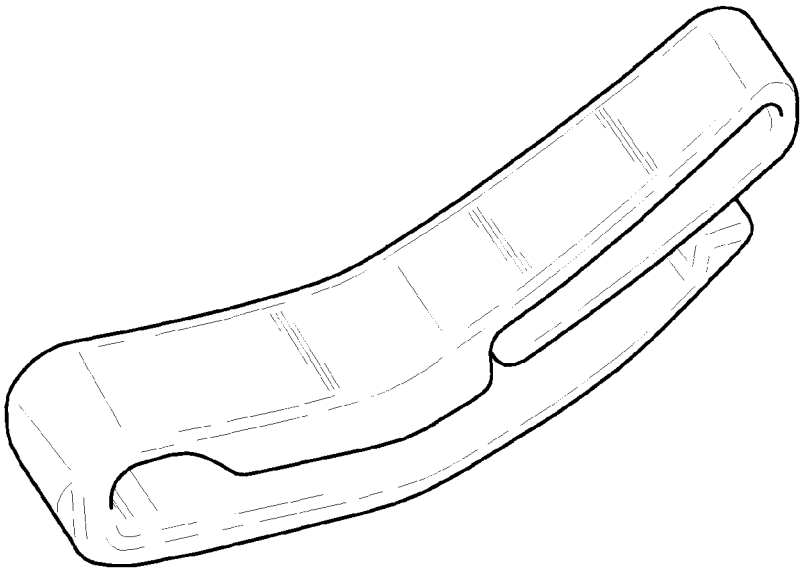
FIG. 5 is an inside bottom perspective view of the eyeglass retention clip according to the embodiment of FIG. 1.
Figure 6:
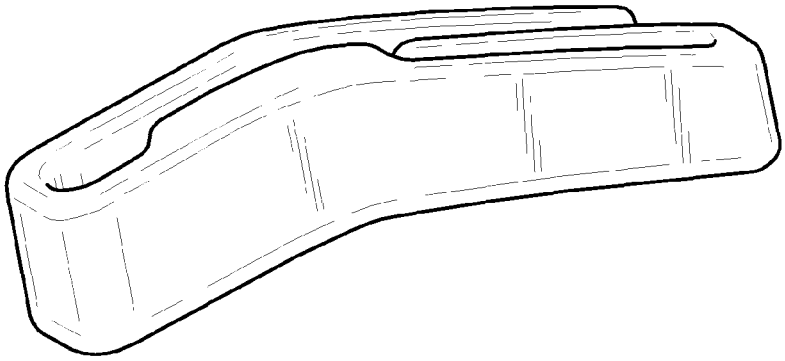
Figure 7:
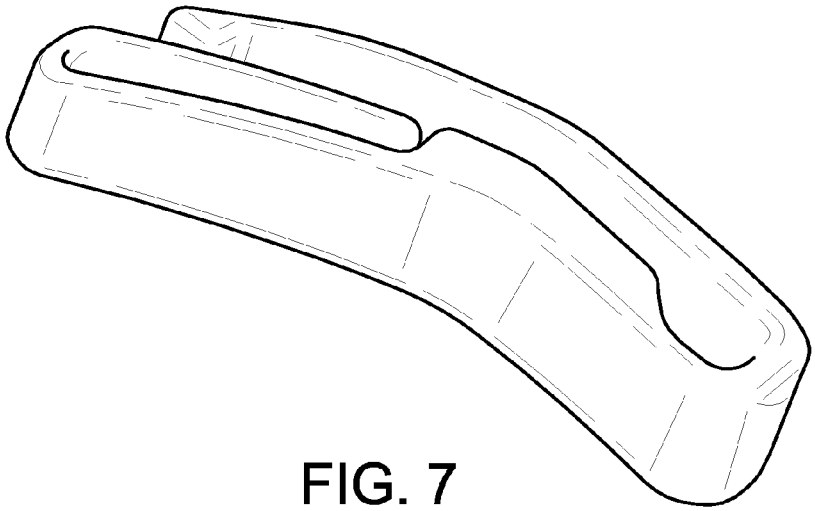
Figure 8:
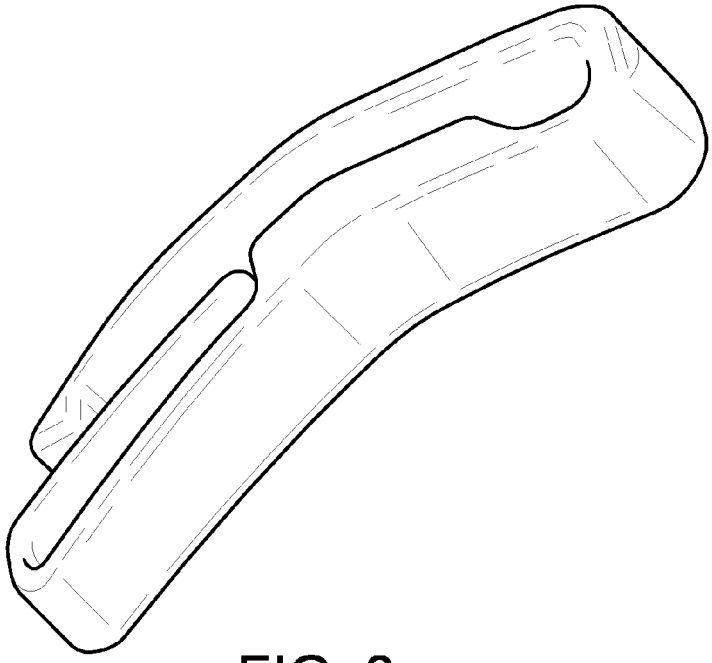
FIG. 8 is an inside top perspective view of the embodiment shown in FIG. 4.

The best mode for carrying out the invention is presented in terms of its preferred embodiment, herein depicted within the Figures.

1. Detailed Description of the Figures

Referring now to FIGS. 1-8, a retention clip 10 for supporting sunglasses on a hat or cap is shown according to the preferred embodiment of the present invention. Each clip 10 is shown, according to the present invention, is anticipated as being used in set of two units being mirror image to each other for use on either side of a user's hat or cap, and in which each sunglass retention clip 10 has a curved inner surface 12, a spring urged clamping means 14 for frictionally impinging to the hat inner sidewall 16, and a retaining spikes 18 that both impinge against the hat outer sidewall as well as form an upper retention walls for securing the eyeglass arms thereto. It has been found through experimentation that the upper end of the inner sidewall 16 can be formed having an orifice 17, with the lower end of the inner sidewall 16 forming a recess 19*a* and extending inward to form a corrugated gripping surface 19*b* in order to better grip and hold to the hat outer sidewall.

While the exterior shape of the preferred embodiment shown in FIGS. 1-8 has a compound angular extension directed rearward, it should be noted that other shapes are contemplated by the present invention, some of which are described in detail below. It is anticipated that in any particular configuration the present invention comprises a curved inner surface 12 that corresponds to the curvature of a human head. The curved inner surface 12 comfortably sits against the user's head when the eyeglass retaining clip 10 is installed on a hat. The purpose of the curved inner surface 12 is to reduce the pressure points on the user's head when the eyeglass retaining clip 10 is used with the hat 20. Conventional eyeglass clips do not accommodate for the shape of the user's head, and thus are not comfortable to wear. The eyeglass retention clip 10 may further comprise a padded or cushioned surface (not shown) in conjunction with the curved inner surface in order to further increase the comfort level. At least one eyeglass retaining clip 10 is needed to hold the sunglasses; however, it is preferred that two clips be positioned on either side of the hat for a secure holding of the eyeglasses.

The sunglass retention clip is preferably manufactured from a resilient plastic material, such as ABS or polycarbonate, having desired material characteristics to fulfill the intended use requirements. The material must be flexible enough to allow enough bending to fit the eyeglass retention clip 10 to a hat, while remaining resilient enough to return to its original shape after it has been removed. One of ordinary skill in the art will realize that a variety of materials may be suitable for such use, and that the use of a resilient plastic material does not preclude the use of other materials. For instance, it is within the scope of the present invention to manufacture the eyeglass retention clip 10 from a composite material or a metal alloy. The resulting eyeglass retention clip 10 must be rigid enough to remain securely fastened to the hat, while simultaneously being resilient enough to allow the user to remove the clip 10 from the hat 20. It is generally contemplated that the present invention be manufactured using an injection molding process; however, other manufacturing processes within the scope of one of ordinary skill in the art are not necessarily precluded.

Another feature of the present invention is a spring-urged clamping means 14 for frictionally impinging to the hat inner sidewall of a hat 20. The clamping means 14 is generally U-shaped and provides an urging force to securely hold the eyeglass retaining clip 10 to the hat 20. The spring-urged clamping means 14 may be manufactured from a resilient plastic or metal. Alternately, the spring-urged means 14 may comprise a metal steel spring molded within a plastic or composite body that makes up the eyeglass retaining clip 10. The portion of the spring-urged clamping means 14 that contacts the inner sidewall of a hat 20 may further have one or more serrated teeth (not shown) to reduce the contact area between the clip 10 and the hat 20, and thereby increase the frictional holding force.

Yet another feature of the present invention is the formation of at least one retaining spike 18 on the inside of the exterior surface of the eyeglass retaining clip 10. The retaining spikes 18 serve a dual purpose by providing means for an increased grip on the outer sidewall of a hat 20 while forming upper and lower retention walls for securing the eyeglass arms thereto. As shown, the retaining spikes 20 abut against the outer sidewall of the hat 20 when the eyeglass retaining clip 10 is installed while simultaneously retaining the eyeglasses' arm. The outside portion of the exterior surface of the eyeglass retaining clip 10 features a space for manufacturer's logo or various advertisements.

Figure 9:
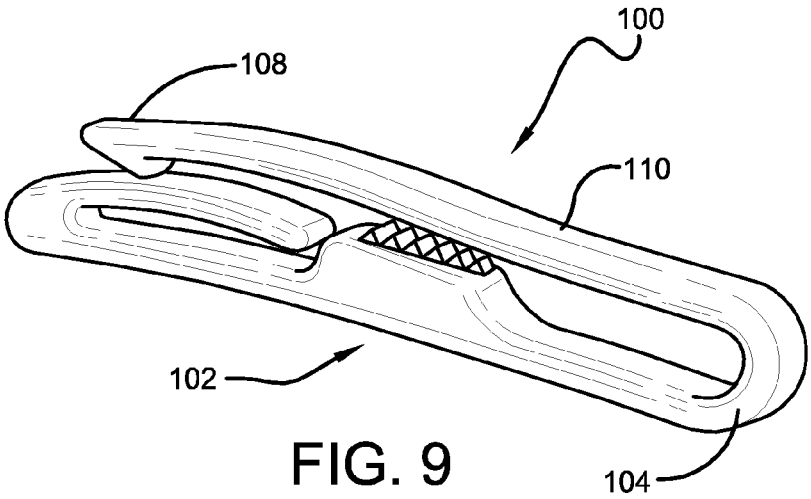
FIG. 9 is a left side perspective view of a first alternate embodiment of an eyeglass retention clip for supporting sunglasses on a hat or cap incorporating a gripping inner over molded surface.
Figure 10:
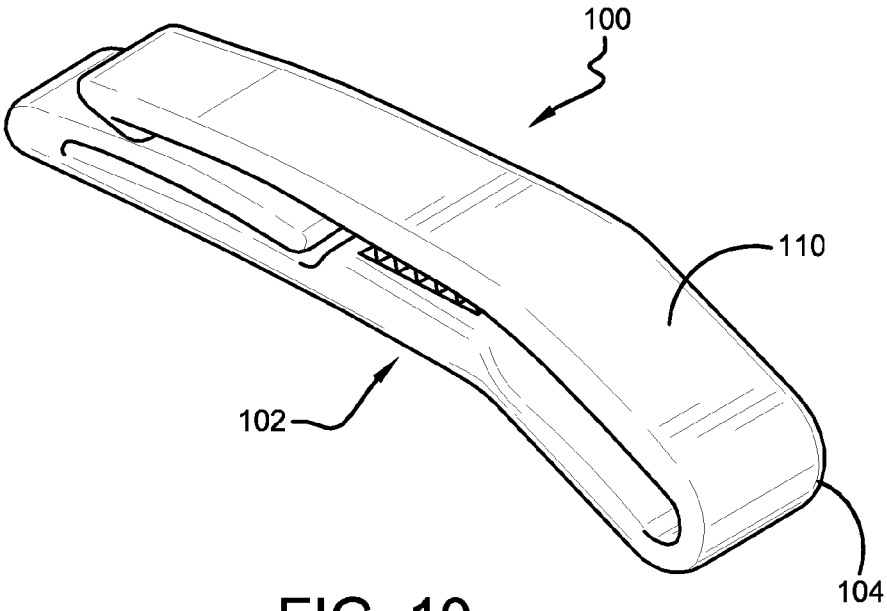
FIG. 10 is a front lower perspective view thereof.
Figure 11:
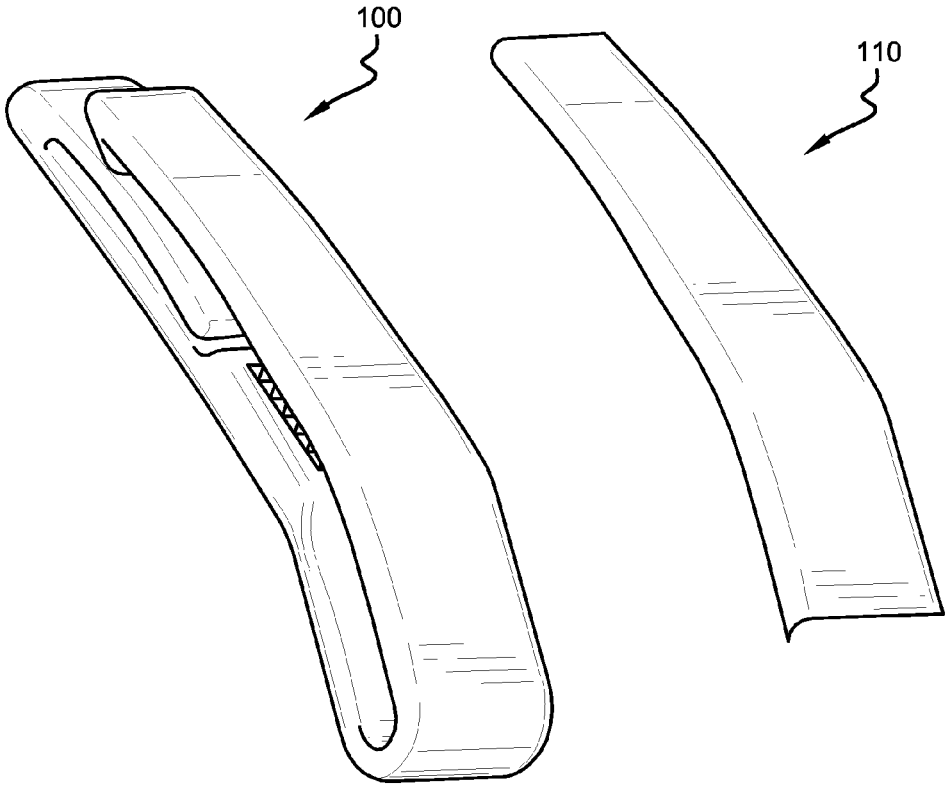
FIG. 11 is an exploded view thereof.

Referring now to FIGS. 9-11, a first alternate embodiment is shown of an eyeglass retention clip 100, shown having the same overall configuration as the preferred embodiment shown and described above but with some modifications, described herein below. The sunglass retention clip 100 has a curved inner surface 102, a spring urged clamping means 104 for frictionally impinging to the hat inner sidewall, and a retaining spike 108 that both impinge against the hat outer sidewall as well as form upper and lower retention walls for securing the eyeglass arms thereto. The additional incorporation of a two-piece overmolded surface 110 is secured to the inner sidewall of the outer impingement part and is anticipated as being formed of a rubber or elastomeric material that has an increased coefficient of friction in order to provide a soft yet grippable surface to secure the arms of sunglasses.

Figure 12:
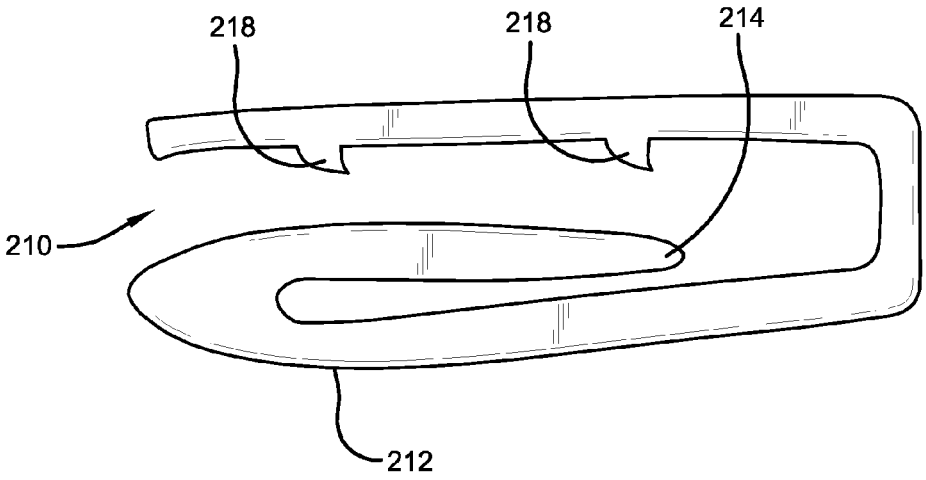
FIG. 12 is a front elevational view of a second alternate embodiment of a eyeglass retention clip for supporting sunglasses on a hat according to the present invention.
Figure 13:
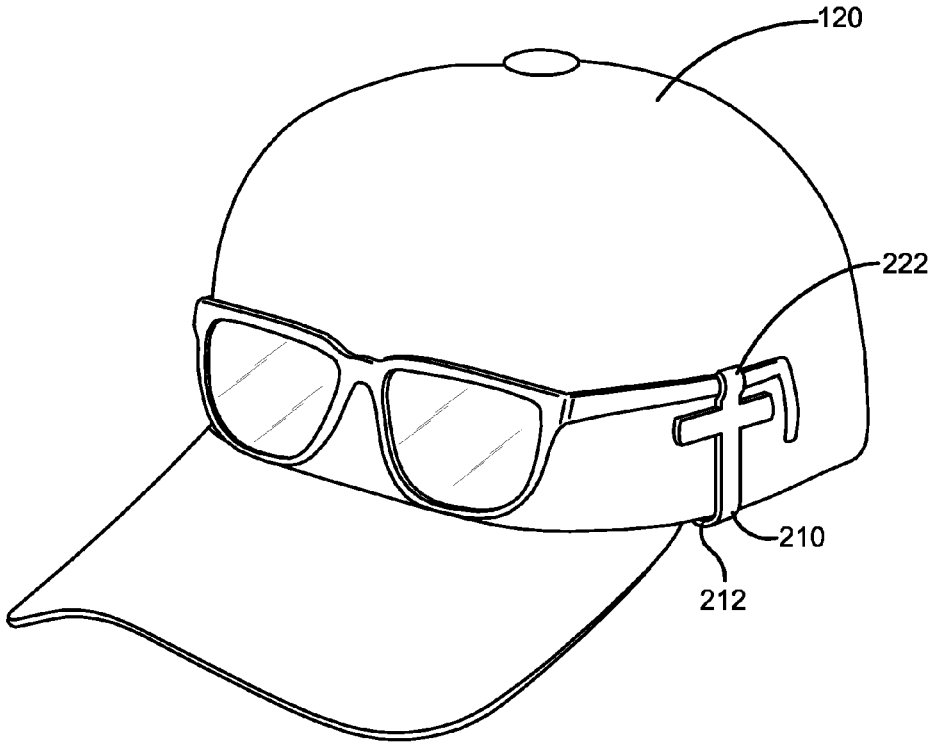
FIG. 13 is a frontal perspective view of the embodiment of FIG. 11 as used with a typical hat and sunglass configuration.
Figure 14:
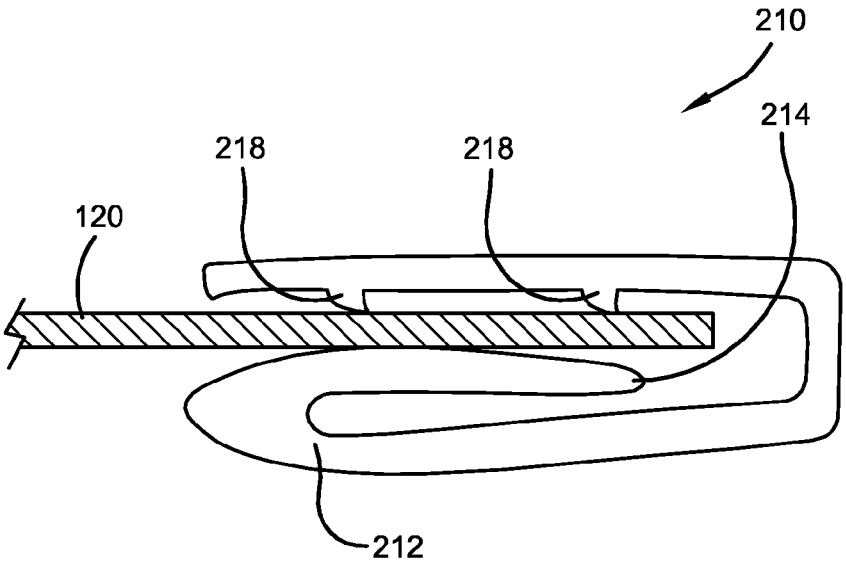
FIG. 14 is a cross sectional view of a hat showing the eyeglass retention clip of FIG. 1.
Figure 15A:
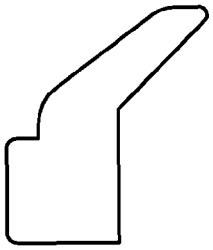
FIG. 15*a* through 15*m* are outside elevational views showing additional alternate embodiments having varying ornamental or aesthetic industrial designs used in conjunction with the teachings of the present invention.
Figure 15B:
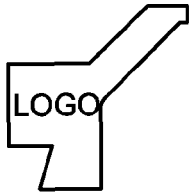
Figure 15C:
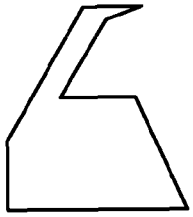
Figure 15D:
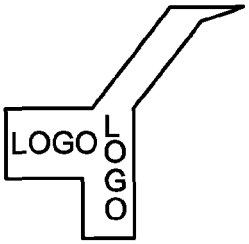
Figure 15E:
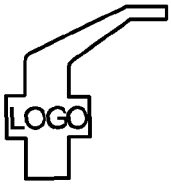
Figure 15F:
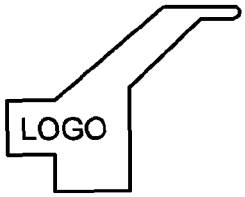
Figure 15G:
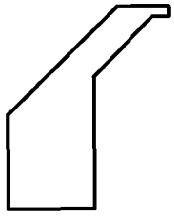
Figure 15H:
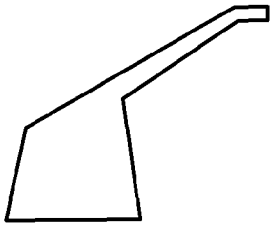
Figure 15I:
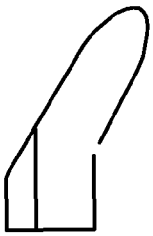
Figure 15J:
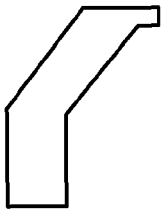
Figure 15K:
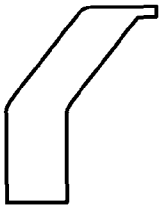
Figure 15L:
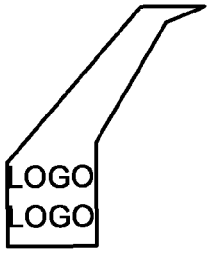
Figure 15M:
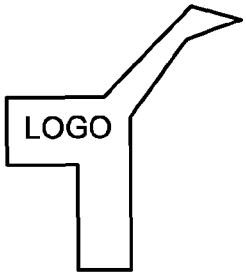

Referring now to FIGS. 12-14, a hat 120 is shown in conjunction with eyeglass retention clip 210, according to a second alternate embodiment of the present invention, in which the sunglass retention clip 210 has a curved inner surface 212, a spring urged clamping means 214 for frictionally impinging to the hat inner sidewall 216, and a pair of retaining spikes 218 that both impinge against the hat outer sidewall as well as form upper and lower retention walls for securing the eyeglass arms thereto. The material must be flexible enough to allow enough bending to fit the eyeglass retention clip 210 to a hat 120, while remaining resilient enough to return to its original shape after it has been removed.

While the exterior shape of the preferred embodiment shown in FIGS. 1-8 and the first alternate embodiment shown in FIGS. 9-11 are of a compound, vertical wing shape and the second alternate embodiment shown in FIGS. 12-14 is generally rectangular, it should be noted that other shapes are contemplated by the present invention. For instance, FIG. 15*a* through 15*m* show variations of these embodiments exhibiting alternate industrial design in which the exterior surface of the eyeglass retaining clip 10 may have a circular, triangular, or any other shape, including specific shapes to accommodate a manufacturer's logo.

2. Operation of the Preferred Embodiment

To use the present invention, the user preferably slides the eyeglass retaining clip 10 around the sidewall of the hat 20. While a single eyeglass retaining clip 10 may be used, it is preferred that two clips be used. The two clips are positioned on opposite sides of the hat 20 such that they are capable of supporting the arms of the eyeglasses in their open configuration. While FIG. 13 illustrates a conventional baseball cap-style hat, it should be noted that the eyeglass attachment clip 10 can be utilized with any other type of hat, provided that the hat does not have a brim that entirely surrounds the hat. Examples of hats include baseball caps, ski caps and hard hats; however, other examples are not necessarily precluded. Additionally, the eyeglass attachment clip 10 is capable of supporting a variety of different eyeglass styles, including sunglasses, prescription eyeglasses, safety glasses and other types of eyewear.

The user may then slide the individual eyeglass arms in between the retaining spikes 18 to securely hold the eyeglasses. The present invention prevents the eyeglasses from falling off from the user's head while not in use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An eyeglass retaining clip for securing eyeglasses to apparel, comprising:

an apparel that includes an outside portion and an inside portion;

an arm for a pair of eyeglasses that are secured to the apparel by the eyeglass retaining clip;

an inner support that includes a curved inner surface;

an outer support connected to the inner support with a "U" shaped member, the "U" shaped member creates a clip in which the outer support fits to the outside portion of the apparel and the inner support fits to the inside portion of the apparel allowing the clip to attach to the apparel;

the inner support includes a spring-urged clamp on an upper portion of the inner support for frictionally impinging to the inside portion of the apparel;

a retaining spike attached to an upper portion of the outer support to impinge against the outside portion of the apparel;

the spring-urged clamp includes an orifice providing a spring-like action in which force from the retaining spike on the outer support is equated by the spring-urged clamp on the inner support; and an extended section on the inner support that directly contacts the inside portion of the apparel to further secure the inner support to the inside portion of the apparel, the extended section is raised in a direction toward the inner support and extends in a direction toward the outer support.

2. The eyeglass retaining clip of claim 1, the curved inner surface is shaped to accommodate a shape of a wearer's head in order to provide a comfortable resting surface when impinged between the apparel and the wearer's head.

3. The eyeglass retaining clip of claim 1, further comprises a padded surface attached to the curved inner surface on the inner support in order to increase a comfort level when said eyeglass retaining clip is impinged between the hat and the wearer's head.

4. The eyeglass retaining clip of claim 1, the spring-urged clamp further comprises one or more serrated teeth to reduce the contact area between the spring-urged clamp and the inside portion of the apparel in order to increase a frictional holding force.

5. The eyeglass retaining clip of claim 1, the eyeglass retaining clip is manufactured from a plastic material.

6. The eyeglass retaining clip of claim 1, the eyeglass retaining clip is manufactured from a metal material.

7. The eyeglass retaining clip of claim 1, the eyeglass retaining clip is manufactured from a composite material.

8. The eyeglass retaining clip of claim 1 further comprises an exterior surface on the outer support, the exterior surface provides a space for at least one of a logo or an advertisement.

9. The eyeglass retaining clip of claim 1, the retaining spike is configured to receive and secure the arm of the eyeglasses.

10. The eyeglass retaining clip of claim 9, the retaining spike immobilizes the arm of the eyeglasses from a perpendicular movement.

11. The eyeglass retaining clip of claim 9 further comprises a second retaining spike positioned below the retaining spike on the outer support, the retaining spike and the second retaining spike create an upper retention wall and a lower retention wall respectively to secure the arm of the eyeglasses from a perpendicular movement.

12. The eyeglass retaining clip of claim 1, the extended section includes serrated teeth to grip the inside portion of the hat, the serrated teeth are positioned toward the outer support.

13. The eyeglass retaining clip of claim 1 further comprises:

the "U" shape member provides a first force to allow the inner support to contact the inner portion of the apparel and the outer support to contact the outer portion of the hat apparel; and the spring-urged clamp provides a second force to allow the inner support to contact the inner portion of the apparel and to increase pressure between the retaining spike and the outside portion of the apparel.

14. A retaining apparatus that secures a pair of glasses to a hat, comprising:

a hat;

a pair of glasses that include an arm;

a clip that attaches to a side of the hat with an outer support and an inner support, the clip comprises:

the inner support has a curved surface to form a shape for a wearer's head;

the outer support;

a "U" shaped member that connects the inner support to the outer support, the "U" shaped member employs a spring tension that encourages the outer support to close onto the inner support;

a retaining spike attached to an upper portion of the outer support, the retaining spike directly contacts an outside portion of the hat to receive and secure an arm of the pair of glasses;

an extended section on the inner support that directly contacts an inside portion of the hat to further secure the inner support to the inside portion of the hat in which the extended section is raised in a direction toward the inner support and extends in a direction toward the outer support, the extended section includes serrated teeth to grip to the inside portion of the hat;

a spring-urged clamp formed on an upper portion of the inner support, the spring-urged clamp provides spring tension against an inside portion of the hat and the retaining spike pushing against the outside portion of the hat; and the outer support provides a lateral force against the arm of the pair of glasses and the spring-urged clamp provides a resisting lateral force through the inside portion of the hat to the arm of the pair of glasses.

15. The retaining apparatus that secures a pair of glasses to a hat of claim 14 further comprises:

the "U" shape member provides a first force to allow the inner support to contact the inner portion of the hat and the outer support to contact the outer portion of the hat; and the spring-urged clamp provides a second force to allow the inner support to contact the inner portion of the hat and to increase pressure between the retaining spike and the outside portion of the hat.

16. The retaining apparatus that secures a pair of glasses to a hat of claim 14 further comprises an exterior surface on the outer support that displays at least one logo.

17. The retaining apparatus that secures a pair of glasses to a hat of claim 14, the clip is at least one of a plastic material, a metal material, or a composite material.

18. The retaining apparatus that secures a pair of glasses to a hat of claim 14, the clip includes a portion of elastomeric material.

19. The retaining apparatus that secures a pair of glasses to a hat of claim 14 further comprises a portion of padding attached to the curved inner surface on the inner support.

20. A retaining apparatus that secures a pair of glasses to a hat, comprising:

a clip that attaches to a side of the hat with an outer support and an inner support, the clip comprises:

the inner support has a curved surface to form a shape for a wearer's head;

the outer support;

a "U" shaped member that connects the inner support to the outer support, the "U" shaped member employs a spring tension that encourages the outer support to close onto the inner support;

a retaining spike attached to an upper portion of the outer support, the retaining spike directly contacts an outside portion of the hat adapted to receive and secure an arm of the pair of glasses;

an extended section on the inner support that directly contacts an inside portion of the hat to further secure the inner support to the inside portion of the hat in which the extended section is increased in size in a direction toward the inner support and extends in a direction toward the outer support, the extended section includes serrated teeth to grip to the inside portion of the hat;

a spring-urged clamp formed on an upper portion of the inner support, the spring-urged claim provides spring tension against an inside portion of the hat and the spike pushing against the outside portion of the hat; and the outer support provides a lateral force against the arm of the pair of glasses and the spring-urged clamp provides a resisting lateral force through the inside portion of the hat to the arm of the pair of glasses;

the "U" shape member provides a first force to allow the inner support to contact the inner portion of the hat and the outer support to contact the outer portion of the hat; and the spring-urged clamp provides a second force to allow the inner support to contact the inner portion of the hat and to increase pressure between the retaining spike and the outside portion of the hat.

* * * * *